US005968240A

United States Patent [19]

Myers et al.

[11] Patent Number: 5,968,240

[45] Date of Patent: Oct. 19, 1999

[54] PHOSPHATE BONDING COMPOSITION

[75] Inventors: Ronald Myers, Pottstown; Mark F. Mosser, Perkiomenville; Kevin Eddinger, Gilbertsville; John E. Hughes, West Chester, all of Pa.

[73] Assignee: Sermatech International Inc., Limerick, Pa.

[21] Appl. No.: 08/914,619

[22] Filed: Aug. 19, 1997

[51] Int. Cl.[6] ..... C09D 5/08; C23F 11/00

[52] U.S. Cl. ..... 106/14.12; 148/261; 148/262; 148/263; 428/457

[58] Field of Search ..... 106/14.12; 148/261, 148/262, 263; 427/37.6, 402, 405; 428/457

[56] References Cited

U.S. PATENT DOCUMENTS

| | | | |
|---|---|---|---|
| 3,248,251 | 4/1966 | Allen | 106/286 |
| 3,395,027 | 7/1968 | Klotz | 106/1 |
| 3,533,859 | 10/1970 | Engesser et al. | 148/6.15 |
| 3,840,378 | 10/1974 | Evans | 106/14 |
| 3,996,073 | 12/1976 | Evans | 148/6.15 |
| 4,316,751 | 2/1982 | Prescott et al. | 148/6.15 |
| 4,347,085 | 8/1982 | Haselkorn et al. | 148/6.16 |
| 4,812,175 | 3/1989 | Reghi | 148/258 |
| 4,895,608 | 1/1990 | Bibber | 148/261 |
| 4,944,813 | 7/1990 | Hosemann et al. | 148/260 |
| 5,200,000 | 4/1993 | Yamamoto et al. | 148/262 |
| 5,232,523 | 8/1993 | Endo et al. | 148/251 |
| 5,242,488 | 9/1993 | Stetson et al. | 106/14.12 |
| 5,279,649 | 1/1994 | Stetson et al. | 106/14.12 |
| 5,279,650 | 1/1994 | Stetson et al. | 106/14.12 |
| 5,478,413 | 12/1995 | Mosser et al. | 148/261 |
| 5,482,746 | 1/1996 | Liberti et al. | 427/379 |
| 5,503,733 | 4/1996 | Speckmann et al. | 205/318 |
| 5,604,040 | 2/1997 | Sugama | 428/472.3 |
| 5,652,064 | 7/1997 | Mosser et al. | 428/472.3 |
| 5,653,790 | 8/1997 | Fotinos et al. | 106/14.12 |

FOREIGN PATENT DOCUMENTS

| | | | |
|---|---|---|---|
| 0 038 097 | 4/1981 | European Pat. Off. . | |
| 0 282 240 | 9/1988 | European Pat. Off. . | |
| 0 565 346 | 10/1993 | European Pat. Off. . | |
| 1 123 537 | 9/1956 | France . | |
| 2 526 814 | 11/1983 | France . | |
| 1234480 | 2/1967 | Germany . | |
| 1621530 | 6/1971 | Germany . | |
| 3407513 | 9/1985 | Germany | 106/14.12 |
| 44 33 946 | 3/1996 | Germany . | |
| 1359339 | 12/1987 | U.S.S.R. | 148/261 |
| 655891 | 8/1951 | United Kingdom | 148/261 |
| 852405 | 10/1960 | United Kingdom . | |
| 863304 | 3/1961 | United Kingdom . | |

OTHER PUBLICATIONS

Chemical Abstracts, vol. 99, No. 14, dated Oct. 3, 1983 for "Application of Electric Insulating Films on Magnetic Strips", Japanese Application No. JP 58 112302 in the name of Kawasaki Steel.

Mosser, Mark F., "Metallic—Ceramic Coatings as Replacements for Cadmium Plating", SAE Technical Paper, No. 900963 (Apr. 1990).

Mosser, Mark F. and Eddinger, Kevin B., "Environmentally Complaint Coatings for Turbine Compressor Applications", AESF 31st Annual Aerospace/Airline Plating and Metal Finishing Forum Proceedings (Apr. 1995).

*Primary Examiner*—Anthony Green

*Attorney, Agent, or Firm*—Seidel, Gonda, Lavorgna & Monaco, PC

[57] ABSTRACT

A heat curable protective coating composition for providing barrier protection to a solid substrate. The coating composition comprises an aqueous solution of phosphate ions and nitrate ions and at least one species of metal ion having a valency greater than +1. The metal ions may be selected from the group consisting of aluminum ions, manganese ions, magnesium ions, cerium ions, cobalt ions, chromium (III) ions, nickel ions, iron ions, copper ions, and zinc ions. The composition has a pH in the range from about 0.5 to about 3.5. The composition is substantially free of chromate ions and molybdate ions. A cured topcoat is substantially clear and has a glossy appearance.

21 Claims, No Drawings

PHOSPHATE BONDING COMPOSITION

FIELD OF THE INVENTION

The present invention relates generally to the field of corrosion protection for metal substrates, and more specifically to bonding solutions and coating compositions free, or substantially free, of carcinogenic or toxic metals.

BACKGROUND OF THE INVENTION

Compositions comprising phosphoric acid and aluminum metal are well known for use in protecting metallic surfaces such as ferrous surfaces from corrosion. In such coating compositions, particulate metallic aluminum, such as flake and/or powder, is combined with a phosphoric acid bonding solution to form a coating composition which is then applied to the metallic surface being treated. After application of the coating to the surface, it may be heated to a first temperature, generally upwards of 500° F. (260° C.), until the coating is rendered essentially water insoluble. Then the coated surface may be cured at a second temperature, generally above 1000° F. (538° C.) to form the final protective coating.

It is often further desirable to provide an extra protective barrier to the metal surface that may provide thermal resistance or simply augment the corrosion protection afforded by the coating and bonding solution described above. In such case, the coating resulting from the combination of particulate metallic aluminum and phosphoric acid bonding solution is termed an "undercoat" or "basecoat". An extra protective layer applied to the cured undercoat is termed a "topcoat". The topcoat may be formed from a bonding solution similar to that used in the undercoat, but containing little or no particulate metal. The result, upon application and curing, is a glassy, ceramic-like layer that provides water resistance, thermal resistance, and augmented corrosion protection. Such a topcoat composition, as known in the art, contains chromate. The topcoat bonding composition may further contain a pigment which imparts visually aesthetic qualities to the coating. The pigment(s) may also be functional and improve certain properties such as corrosion resistance, erosion life, and bond strength.

Though basecoat coating compositions contain particulate aluminum metal, care must be taken in the preparation of phosphate-based coatings. The phosphoric acid bonding solution can react with the aluminum. Such reactions are considerably exothermic and can be very violent, causing the aluminum powder to burn or even explode. These reactions may result in the conversion of the metallic aluminum into various salts. Protective topcoats, though not containing particulate aluminum metal, are equally susceptible to reaction with metallic aluminum because protective topcoats are directly applied to metallic aluminum-containing basecoats. In either case, such reactions interfere with the formation of suitable protective coatings. Thus, the reactive stability of a coating formulation in the presence of metallic aluminum is of foremost concern.

U.S. Pat. No. 3,248,251 to Allen, describes coating compositions consisting essentially of a slurry of solid inorganic particulate material (such as metallic aluminum) in an aqueous acidic bonding solution containing dissolved metal chromate, dichromate or molybdate, and phosphate. It was found that the addition of chromates or molybdates to the acidic bonding solution effectively passivated the solution toward aluminum and inhibited the oxidation of metallic aluminum, allowing particulate aluminum to be combined with the bonding solution without the undesirable chemical reaction between the acidic bonding solution and the aluminum. These "Allen" coatings have been and still are successfully used to provide high quality coatings which protect ferrous metal alloy surfaces from oxidation and corrosion, particularly at high temperatures. It is also known that the inclusion of chromium or molybdenum in the coating composition, whether used in corrosion resistant basecoats or protective topcoats, provides a coating having improved corrosion resistance.

However, while chromates and molybdates have been used successfully to reduce the reactivity of the aluminum in such coating compositions and to improve the corrosion resistance in the coatings, the use of chromates and molybdates has become a problem because of environmental considerations. Chromates are considered carcinogenic. Molybdenum is classified as a toxic heavy metal. It is therefore desirable to avoid the use of solutions of their salts, or at least to reduce their use. For this reason, it has become desirable to develop a phosphate/aluminum corrosion resistant basecoat composition which requires little or no chromate or molybdate to control the reactivity between the acidic phosphate bonding solution and the particulate aluminum added thereto. Similarly, it has become equally desirable to develop a protective topcoat having little or no chromate or molybdate. Such coating compositions should protect ferrous metal alloy surfaces from the oxidation and corrosive environmental conditions, especially at high temperatures, approximately as well as and preferably better than the so-called Allen coatings.

Efforts have been made to exclude chromate and molybdate from coating compositions while maintaining stable formulations. U.S. Pat. No. 5,242,488 to Stetson et al., describes a basecoat coating composition for ferrous alloys which does not require either chromates or molybdates to control the reaction between the bonding solution and the powdered aluminum. The composition consists essentially of a slurry mixture of a bonding solution and aluminum powder. The bonding solution consists essentially of water, phosphoric acid ($H_3PO_4$), and aluminum ions. The bonding solution must contain sufficient aluminum ions in solution so that it is substantially equilibrated with respect to aluminum metal pigments, i.e., the amount of aluminum in solution must be substantially at the saturation point, thus leaving the bonding solution essentially inert with respect to any subsequent additions of aluminum.

This Stetson patent also teaches that magnesium, while not essential, may desirably be used to at least partially neutralize the aqueous phosphoric acid mixture, either before or after equilibration of the mixture with aluminum. The magnesium compound used is either MgO or $MgCO_3$. All examples given in the patent utilize magnesium ions.

U.S. Pat. No. 5,279,649, also to Stetson, et al., discloses substantially the same compositions to which $V_2O_5$ has been added to produce vanadate ion, adding another inhibitor to the aluminum equilibrated mixture. Addition of $V_2O_5$ is an example of the addition of a toxic substance, listed on the OSHA extremely hazardous substance list and also subject to Clean Air Act and CERCLA regulation.

Further, in U.S. Pat. No. 5,279,650, also to Stetson, et al., a seal coating composition containing vanadate ion and iron oxide ($Fe_2O_3$) powder is disclosed.

All three of these Stetson coating compositions are designed to avoid the use of chromium and molybdate ions and require the bonding solution to be equilibrated with respect to further additions of aluminum as described in these patents.

Although the Stetson patents indicate that these formulations control the reactivity between the bonding solution and the aluminum, some reaction still occurs between the bonding solution and the powdered aluminum when the slurry compositions of the Stetson patents are formulated.

U.S. Pat. No. 5,478,413 to Mosser et al. is directed to coating compositions lacking chromium or molybdenum. These coatings are pigmented with aluminum powder and can be applied to all ferrous alloys. These coatings may require a topcoat to be applied thereon for satisfactory protection of the metal substrate in some applications. Excluding the particulate aluminum, these coatings do not form glossy, sufficiently hard films.

U.S. Pat. No. 3,395,027 to Klotz is directed to a corrosion resistant basecoat composition containing phosphate, nitrate, chromate, magnesium ions, and a particulate metal. The coatings of Klotz are primarily directed towards protection of a magnesium surface.

None of these patents disclose coatings which provide a clear topcoat composition comprising a chromate- and molybdate-free formulation.

It is therefore desired to formulate a chromate- and molybdate-free bonding solution, or one which is of reduced chromium and molybdenum content, which not only has a reduced reactivity with particulate aluminum when the two are combined to form a coating composition, but also serves as an effective topcoat composition while being free of toxic additives. Such a bonding solution should also form, upon curing, a hard, glossy surface. Such a bonding solution should also bond to, but not attack, ferrous alloys. The present invention provides such a composition.

SUMMARY OF THE INVENTION

The present invention includes a heat curable protective coating composition for providing barrier protection to a solid substrate. The topcoat composition comprises an aqueous solution of phosphate ions and nitrate ions and at least one species of metal ion having a valency greater than +1. The composition has a pH in the range from about 0.5 to about 3.5. The composition is substantially free of chromate ions and molybdate ions. Cured topcoat has a glossy appearance and is substantially clear.

The metal ion may be selected from the group consisting of aluminum ions, magnesium ions, manganese ions, cerium ions, cobalt ions, chromium(III) ions, nickel ions, iron ions, copper ions, and zinc ions. The coating composition may also contain borate ions. Phosphate ions and nitrate ions are preferably present in the composition in a mole ratio of phosphate ion to nitrate ion in the range from about 1.5:1 to about 15:1. The preferred ratio of the number of moles of borate ion to the number of moles of phosphate ion in the composition is less than or equal to about 0.5:1. The ratio of the number of moles of phosphate ion to the number of moles of metal ion is greater than or equal to about 1:1, and preferably in the range from about 1:1 to about 2:1. The topcoat applied to a surface and cured can have a surface profile less than 30 microinches at a 0.030 inch cut-off.

A heat curable protective coating composition for providing barrier protection to a solid substrate is also provided. The composition comprises an aqueous solution containing phosphate ions and nitrate ions and at least one species of metal ion having a valency greater than +1. The composition further contains a pigment. The composition has a pH in the range from about 0.5 to about 3.5. The composition is substantially free of chromate ions and molybdate ions, and a cured topcoat has a glossy appearance.

The metal ion may be selected from the group consisting of aluminum ions, magnesium ions, manganese ions, cerium ions, cobalt ions, chromium(III) ions, nickel ions, iron ions, copper ions, and zinc ions. The pigmented coating composition may also contain borate ions. Phosphate ions and nitrate ions are preferably present in the composition in a molar ratio of phosphate ion to nitrate ion in the range from about 1.5:1 to about 15:1. The preferred ratio of the number of moles of borate ion to the number of moles of phosphate ion in the composition is less than or equal to about 0.5:1. The ratio of the number of moles of phosphate ion to the number of moles of metal ion is greater than or equal to about 1:1, and preferably in the range from about 1:1 to about 2:1.

The present invention further includes a method for coating a solid substrate, comprising the steps of applying the coatings described above to the surface of the substrate and subjecting the substrate to heating to cure the coating.

A method for coating a solid substrate pretreated with a corrosion resistant basecoat is also provided, comprising the steps of applying the compositions described above to the surface of the cured basecoat and subjecting the substrate to heating to cure the topcoat.

The present invention also includes an article of manufacture comprising a solid substrate having deposited thereon a layer formed by coating said substrate with and then drying and heat curing the composition. The composition comprises an aqueous solution of phosphate ions and nitrate ions and at least one species of metal ion having a valency greater than +1. The composition has a pH in the range from about 0.5 to about 3.5. The composition is substantially free of chromate ions and molybdate ions and a cured topcoat has a glossy appearance and is substantially clear.

The metal ion of the composition may be selected from the group consisting of aluminum ions, manganese ions, magnesium ions, cerium ions, cobalt ions, chromium(III) ions, nickel ions, iron ions, copper ions, and zinc ions. The article of manufacture may have a cured coating of the composition having a surface profile less than 30 microinches at a 0.030 inch cut-off.

The present invention also includes a heat curable protective coating composition for providing barrier protection to a solid substrate. The topcoat composition comprises an aqueous solution of phosphate ions and nitrate ions and at least one species of metal ion having a valency greater than +1. The composition has a pH in the range from about 0.5 to about 3.5. The composition is substantially free of chromate ions, but may contain molybdate ions.

DETAILED DESCRIPTION OF THE INVENTION

The bonding solution of the present invention comprises an aqueous solution containing phosphate ion and nitrate ion. The bonding solution may be conveniently referred to as a phosphate/nitrate system. The bonding solution preferably further contains borate ion and at least one species of metal ion having a valency greater than +1. The metal ions may be selected from the group consisting of aluminum ions, magnesium ions, iron ions, cerium ions, cobalt ions, nickel ions, manganese ions, copper ions, and zinc ions. Cobalt ions, nickel ions, and chromium(III) ions, though toxic to some extent, are far less toxic than chromate and molybdate ions and can therefore be used in the composition, particularly in the prescribed concentrations. This phosphate/nitrate bonding composition may have a pigment added, as well.

The bonding solution is substantially free of regulated toxic chromate or molybdate. "Substantially free", as used herein, is understood to mean essentially or completely free of said constituent, or inclusive of trace amounts of same. "Trace amounts" are those quantitative levels of a chemical constituent that are barely detectable and provide no benefit to the functional or aesthetic properties of the subject composition. As used herein, the term "chromate" refers to chromate ion, dichromate ion, and hexavalent chromium ion. Molybdate ions may be added in small amounts, subject to regulatory limitations, because the toxicity of the molybdate is lower than chromate and is not carcinogenic, per current understanding.

The bonding solution of the present invention is particularly directed towards a protective topcoat, but can be used as a coating for ferrous alloys, aluminum alloys, nickel alloys, titanium alloys, cobalt alloys, and other metal surfaces. It can be applied to a variety of metallic surfaces, glass, and ceramics, limited only by the surface's ability to survive the curing process and the surface's relative lack of reactivity with the coating composition. A topcoat formed in accordance with the present invention has a thickness in the range from about 0.1 mil to about 1.0 mil (1 mil=1/1,000 in.). As used herein, the term "topcoat" refers to an acidic bonding composition substantially free of particulate metal that is applied to a cured basecoat in order to provide additional protection from corrosion, heat, water, and the like. A topcoat may also be applied directly to a metal substrate, as well. A topcoat layer applied directly to a metal substrate as the only protective barrier may be up to about 3.0 mils thick. The topcoat may or may not contain a pigment. A basecoat is understood to refer to a particulate metal-containing acidic composition applied directly to a metal substrate and having a principal function of corrosion resistance.

Although one or more individual components of the topcoat bonding solution may have low or reduced solubility or miscibility in water or in aqueous phosphoric acid, ideally the bonding composition as a whole should be an aqueous solution. It is recognized, however, that some of the less soluble or miscible components may be present in suspension or other non-solution form. Thus, in accordance with the invention, the term "aqueous bonding solution" or "bonding solution" is intended to include a composition in which one or more of its components may not be fully dissolved, but may be present in other form.

A basecoat is provided having a thickness in the range from about 0.25 mil to about 5.0 mil. The basecoat composition generally comprises an acidic solution, preferably containing phosphoric acid, and particulate metal (preferably aluminum), as well as a source of a metallic ion to modify the reactivity of the particulate metal in the solution and participate in the corrosion resistance function of the coating.

Phosphate ion may be introduced into the aqueous bonding solution of the present invention in the form of phosphoric acid, in the form of phosphates of the metal or metals desired to be included as the metal cation, or in both forms. Any source of soluble phosphate may be used, though such choice may be limited by environmental considerations and pH effects. The preferred source is phosphoric acid, and in particular, a commercially-available 85% phosphoric acid solution. It is understood that the term "phosphate" is intended to include not only the $PO_4^{-3}$ ion, but also $HPO_4^{-2}$ and $H_2PO_4^{-}$ ions. All three, for example, result from the dissociation and ionization of $H_3PO_4$ in solution and the hydrogen phosphate ions generally will, to some extent, be present in the compositions of this invention.

Nitrate ion may be introduced to the bonding solution of the present invention in the form of nitric acid, in the form of nitrates of the metal or metals desired to be included as the metal cation, or in both forms. A preferred source is ferric nitrate nonahydrate and aluminum nitrate nonahydrate.

In the topcoat composition of the invention, the ratio of the number of moles of phosphate ion to the number of moles of nitrate ion is in the range from about 1.5:1 to about 15:1, and preferably in the range from about 2.5:1 to about 11.5:1.

Borate ion may be introduced to the aqueous bonding solution of the present invention in the form of boron oxide, boric acid, or in the form of other acid-soluble borate salts. Boron oxide is a preferred form. It is believed that the borate ion participates in stabilizing the composition with respect to reaction with a metal surface. The borate may also promote better sprayability and formation of a hard, smooth surface upon curing.

In the topcoat composition of the invention, the preferred ratio of the number of moles of borate ion to the number of moles of phosphate ion is less than or equal to about 0.5:1, and most preferably in the range from about 0.1:1 to about 0.02:1.

The bonding solution of the present invention includes at least one species of metal ion having a valency greater than +1, and preferably, selected from the group consisting of aluminum ions, magnesium ions, iron ions, cerium ions, cobalt ions, chromium(III) ions, nickel ions, manganese ions, copper ions, and zinc ions. These ions are preferably delivered to the bonding solution as the metallic cations of nitrate-containing salts. These ions may also be delivered as, for example, carbonates, phosphates, oxides, or hydroxides of the respective cation. Free metals may also be introduced to acid solution as a source of metal ion. These metal ions may participate in raising the pH of the bonding solution. However, it is believed that these metal ions in the bonding solution act as "modifying ions". These ions are believed to serve as cross-linking agents for the phosphorus-oxygen chains formed in the cured matrix and thus promote hard, smooth, glossy coatings when cured. These ions may have a substantial impact on the physical properties characteristic of the coating, such as viscosity, film forming properties, and thermal stability.

It is contemplated that any species of metallic cation having a valency greater than +1 may be satisfactory for inclusion in the bonding solution of the present invention. Group IA metals (e.g., lithium, sodium, and potassium) are not desirable. Further, environmental considerations may limit the acceptable choices of cations introduced to the solution. Cobalt or nickel ions, for example, are listed as toxic substances and may be desirably omitted from a formulation. However, some toxic metallic ions, despite a listing as such, may be included in the bonding composition in concentrations below the regulated levels of those ions.

In the topcoat composition of the invention, the preferred ratio of the number of moles of phosphate ion to the number of moles of metal ion is calculated as the ratio of the number of moles of phosphate ion to the adjusted number of moles of total metallic cations. This ratio is greater than or equal to about 1:1, and preferably in the range from about 1:1 to about 2:1. The adjusted mole metallic cation total is defined as the number of moles of trivalent cations added to 1.5 times the number of moles of divalent cations.

The phosphate/nitrate acidic bonding solution may be adjusted to a pH in the range from about 0.5 to about 3.5, preferably from about 1.5 to about 3.5, and most preferably from about 1.5 to about 2.5. The pH is adjusted by addition of the source of metal cation to the solution, while pH is simultaneously monitored.

A preferred embodiment of the invention has a mole ratio of phosphate ion:nitrate ion:total metal cations:borate ions of about 1:0.32:0.70:0.06.

Deionized water constitutes the balance of the composition. Deionized water is present in sufficient quantity to solubilize the composition components and in such quantity to achieve the desired pH.

It is assumed that all soluble components in the bonding solution completely dissolve.

As noted above, the bonding solution to be employed as a topcoat may incorporate a pigment. In such case, the addition of a pigment to the aqueous phosphate/nitrate system would create a suspension of the pigment suspended in the composition. A pigmented bonding solution may contain a water-insoluble pigment, a surfactant to help disperse the pigment, and an organic solvent to promote sprayability of the pigmented solution. It is contemplated that any water-insoluble pigment may be successfully delivered in the bonding solution of the present invention. The choice of pigment may be dependent upon aesthetic concerns. An example of a commonly used pigment is magnesium ferrite. Any pigment may be employed as long as it is stable in the acidic phosphate/nitrate system, can survive the curing process, and is delivered in sufficiently small particles so as to enable the surface profile or smoothness of the cured coating to be within acceptable tolerances for a particular application. Acceptable pigments may be found in the Federation of Societies for Coating Technology's Series on Coatings Technology.

The term "pigment" is understood to additionally include water-insoluble materials that impart functional properties to the bonding composition, and not necessarily a desired color. For example, refractory metal compounds such as silica, zirconia, alumina, silicon carbide, aluminum silicate, and metal powders may be added for higher heat resistance. Dry lubricants such as, for example, graphite or tungsten disulfide, may also be added to the composition. The coating compositions of the present invention may also include one or more leachable corrosion inhibitors. The leachable pigment is one which is capable of inhibiting or passivating the corrosion of a metal substrate. The leachable pigment is preferably a salt containing environmentally acceptable metals, such as zinc aluminum phosphate and others set forth in "Inorganic Primer Pigments", Federation Series on Coatings Technology, which is incorporated herein by reference.

The preferred mole ratios of phosphate ion, nitrate ion, metal ion, and borate ion are unchanged in those systems to which a pigment is added. The preparation of a pigmented topcoat composition of the invention requires that the pigment be added to a quantity of the bonding solution prepared as described above.

A surfactant solution may be added to the bonding solution of the present invention to promote sprayability and film-forming properties. For example, if a surfactant is utilized, a volumetric equivalent of about 10% of the bonding solution is added, containing surfactant solution. The surfactant may be any commercially-available non-ionic surfactant. A preferred surfactant is Triton X-100 from Union Carbide. The surfactant is preferably diluted in deionized water to form a surfactant solution so that it is about 0.06 wt % of the surfactant solution. Cellosolve acetate solution or other solvent can be added to improve sprayability. Depending on the solvent added, 5–15% by volume of organic solvent may be added to the composition. The use of a surfactant or an organic solvent is not required to apply the bonding composition of the present invention.

The preparation of the bonding solution and coatings of the present invention follow conventional methods well-known in the art. The components of the phosphate/nitrate system are added and mixed at room temperature under low-shear mixing conditions.

The coating compositions of the invention are applied in conventional ways to the metal substrate surface or, in the case of protective topcoats, directly to a cured basecoat. It is contemplated that all metallic substrates are candidates for protective coatings of the present invention. While ferrous alloy substrates are the preferred metal substrate, it is believed that any solid substrate is, in fact, a suitable candidate for the coatings of the present invention, limited only by the ability of the solid substrate to survive the curing process.

Protective topcoats of the present invention are similarly applied to cured corrosion resistant basecoats in conventional ways. These protective topcoats may also be applied directly to a metal substrate, lacking a basecoat, for those instances where protective demands do not include corrosion resistance.

When applying the coatings, it is generally desirable to degrease the part to be coated, abrade the surface, and apply the coating of the invention by any suitable means, such as by spraying, brushing, dipping, dip spinning, and the like. The coating is dried, then cured. By "curing" is meant heat induced chemical changes that solidify the topcoat composition. The coatings, both basecoats and topcoats, are dried at about 175° F. for about 10 to 15 minutes. Curing preferably takes place at 650° F. for about 30 minutes.

The basecoats as cured at 650° F. are not electrically conductive and therefore cannot provide galvanic protection against corrosion of the underlying substrate material. However, the coating may be made electrically conductive by burnishing with glass beads, the use of abrasive media at low application pressure, or mechanically cold-working in other ways to produce a conductive sacrificial coating or by heating as specified in MIL-C-81751B specification (incorporated herein by reference). In this manner the coatings can, by mechanical or thermal processes, be made electrically conductive and thereby produce galvanic as well as barrier protection of the underlying ferrous alloy substrate. Desirably, after the second basecoat is applied, dried, cured and processed to make it electrically conductive, the surface of the coating is sealed with the topcoat bonding solution to further increase the oxidation and corrosion protection provided by the coating, and to decrease the rate of consumption of aluminum in the coating during service. The topcoat also reduces the profile of the coating, making the surface smoother than it would be without a topcoat. The topcoats are also dried and cured, as above.

In assessing the viability of a particular coating formulation, several qualitative analyses are performed. The two properties of concern for a coating are (a) satisfactory film-forming characteristics for a cured formulation and (b) satisfactory stability of an uncured formulation in contact with a metal or metal-containing substrate. The stability test is relevant to both basecoat and protective topcoat formulations. For basecoats, it is important to know the stability of the uncured formulation in contact with particulate aluminum. Since the protective topcoat may be applied directly onto a burnished particulate aluminum-containing basecoat, the uncured topcoat would be in direct contact with metallic aluminum exposed on a high surface area substrate.

To assess the film-forming and reactive stability characteristics, the following tests may be conducted.

Approximately 1 ml of as-prepared liquid formulation is placed in a small aluminum weighing dish. The sample is then dried at 175° F. for about 10–15 minutes, then cured at 650° F. for about 30 minutes. The sample is visually examined after both drying and curing. The cured sample is examined under magnification. A "good" coating is one which is described as glassy, smooth, and having a glossy or satin-like surface or luster. A good coating may exhibit some degree of micro-cracking. Chromate-containing coatings are often micro-cracked. A poor coating very often has a rough, dull surface with little or no glossiness. Most notably (for the purposes of assessing and comparing the coatings of the present invention), poor coatings often exhibit "holing", or the appearance of holes. Holing causes blistering and peeling of the coating possibly due to reactions with the metal substrate or due to surface tension effects. Poor coatings may also exhibit a wet appearance after curing, possibly indicating an undesirable hygroscopic effect.

The as-prepared liquid formulation is also assessed for film-forming and aluminum reactivity by applying (brushing) the liquid formulation onto grit-burnished 2024 aluminum panels. Reactive (and unstable) formulations will exhibit bubbling upon contact with the aluminum. Formulations containing transition metal ions may further display a color change upon application to the aluminum panel, due to reduction-oxidation reactions at the metal surface. The coated aluminum panel is dried and cured as set forth in the first test, and examined and evaluated under the same criteria. Additional tests could be carried out on mild steel (AISI 1010) substrates.

Another qualitative test requires that the integrity of a cured coating be assessed by bending a metallic substrate treated with the subject coating around a mandrel to an angle of 90 degrees. An acceptable coating will not crack or flake from the metal surface under the mechanical stress.

A series of analyses are also conducted pursuant to prescribed ASTM performance standards. These tests are summarized in Table I.

TABLE 1

PERFORMANCE TESTS

| Test Description | Requirement |
|---|---|
| 168 hours salt spray ASTM B117 | No galvanic attack of base metal. |
| 168 hours salt spray per ASTM B117 scribed "X" | No basecoat attack. (White corrosion products present). |
| Bend Test, 90 degree around 14X mandrel | No separation from basecoat. |
| Oxidation resistance, 24 hours at 700° F., 4 hours at 1200° F. | No delamination from basecoat. |
| Thermal Shock. 2 hours at 1000° F., then quench in cold water, 10 cycles. | No cracking, blistering, or delamination from basecoat. |
| Crosshatch adhesion test per ASTM D3359, Method B. | No removal of topcoat. |
| Impact resistance by rapid deformation per ASTM D2794 intrusive test. | No cracking of flaking off of topcoat at 40 in-lbs. |
| Impact resistance by rapid deformation per ASTM D2794 extrusive test. | No cracking or flaking off of topcoat at 40 in-lbs. |
| Tensile bond strength testing per ASTM C633 | Failure of topcoat at PSI >3000 |

The sprayability of a basecoat or topcoat composition is also assessed. Sprayability is a measure of the ease with which the coating may be mechanically sprayed to a substrate. Sprayability is a measure of the rheological properties of the composition, which in turn are dependent upon the stability of the composition, the concentrations of constituent species, and temperature.

The surface finish profile, or "smoothness," of a cured coating is measured. A Hommelwerke Model T500 Profilometer apparatus is employed to obtain $R_a$ values (in microinches) at 0.030 inch cut-off.

There are several advantages to the bonding compositions of the present invention. As noted, these phosphate/nitrate systems do not contain or are substantially free of chromate or molybdate ions, or other like toxic or undesirable metals, which is an environmental objective. In situations where more permissive environmental conditions permit the use of such metals as chromium, molybdenum, nickel, and others, it is possible to use such metals in the bonding and/or the coating composition. However, the coatings of the present invention exhibit corrosion resistance properties as good as, if not better than, chromate- or molybdate-containing coatings. Similarly, the coatings of the invention exhibit film-forming and reactive stability towards a metal substrate superior to that of chromate- or molybdate-free formulations previously known. The coatings also exhibit excellent sprayability.

Additionally, unpigmented topcoats of the present invention form clear, hard, glossy coatings. A clear topcoat is a topcoat that is easily seen through, or transparent. The term "glossy" is understood to describe a surface that has a degree of luster and shine, almost satin-like in appearance. These topcoats also provide a very smooth surface, or profile, required for certain applications where boundary layer effects must be minimized, such as in aerospace applications. Clear topcoats of the present invention can provide surface profiles having an $R_a$ value less than 30 microinches at 0.030 inches cut-off.

The following Examples are merely illustrative of the invention and are not intended to be limiting. Curing, where noted, occurred at 650° F. for about 30 minutes after drying at 175° F. for about 10 to 15 minutes. All tests were conducted as described above.

EXAMPLE 1

A bonding solution for application as a clear protective topcoat was prepared, having the formulation:

| | |
|---|---|
| 240.2 g | deionized water |
| 110.9 g | 85% phosphoric acid |
| 20.0 g | ferric nitrate nonahydrate |
| 20.0 g | aluminum nitrate nonahydrate |
| 2 g | boron oxide |
| 47.6 g | magnesium carbonate |

To this formulation, having a pH of 2.0, was added a volumetric equivalent of about 10% of the bonding solution containing a surfactant solution. The surfactant solution comprises a 0.06 wt % solution of a non-ionic surfactant, Triton X-100. An additional volume of cellosolve acetate is added to the bonding solution at a volumetric equivalent of about 10% of the bonding solution. The bonding solution was sprayed onto a piece of mild carbon 1010 steel that had been pre-treated with one coat of a basecoat composition not of the present invention. The basecoat was formulated from 200 ml of a bonding solution (formulated from 800 g deionized water, 388 g 85% phosphoric acid solution, 17.5 g zinc oxide, 10.3 g ferric phosphate, 120 g magnesium carbonate, and 31 g boric acid), 50 ml deionized water, 8 g zinc aluminum phosphate, and 120 g aluminum powder (4.5 micron average particle size). The basecoat was grit burnished. The topcoat formulation was then dried and cured.

The topcoat bonding solution was found to have very good sprayability. After drying at about 175° F. for about 10 minutes and then curing at 650° F. for about 30 minutes, the coated steel panel was subjected to salt spray testing. After more than 200 hours of 5% salt spray exposure, the coated panel showed no signs of red rust.

This protective coating was also prepared and applied, as set forth above, to a metal test substrate that was bent 90° around a mandrel. The cured coating remained intact and did not flake or crack from the surface of the substrate on which it had been applied.

The topcoat formulation was also applied to 1010 steel pre-treated with one coat of a basecoat composition as described above and subjected to the performance tests set forth in Table I. The topcoated specimen passed all tests.

EXAMPLE 2

A bonding solution for application as a clear, protective topcoat was prepared, having the formulation:

| | |
|---|---|
| 240.2 g | deionized water |
| 110.9 g | 85% phosphoric acid |
| 20 g | ferric nitrate nonahydrate |
| 20 g | aluminum nitrate nonahydrate |
| 47.8 g | magnesium carbonate |

To this formulation was added a volumetric equivalent of about 10% of the bonding solution containing a surfactant solution. The surfactant solution comprises a 0.06 wt % solution of a non-ionic surfactant, Triton X-100. An additional volume of cellosolve acetate is added to the bonding solution at a volumetric equivalent of about 10% of the bonding solution. The bonding solution was sprayed onto a piece of mild carbon 1010 steel that had been pre-treated with one coat of a basecoat composition as set forth in Example 1.

The topcoat bonding solution was found to have very good sprayability. After drying at about 175° F. for about 10 minutes and then curing at 650° F. for about 30 minutes, the coated steel panel was subjected to salt spray testing. After more than 200 hours of 5% salt spray exposure, the coated panel showed no signs of red rust.

This protective coating was also prepared and applied, as set forth above, to a metal test substrate that was bent 90° around a mandrel. The cured coating remained intact and did not flake or crack from the surface of the substrate on which it had been applied.

EXAMPLE 3

A bonding solution for application as a clear, protective topcoat was prepared, having the formulation:

| | |
|---|---|
| 240.2 g | deionized water |
| 110.9 g | 85% phosphoric acid |
| 20 g | ferric nitrate nonahydrate |
| 44.0 g | magnesium carbonate |

To this formulation was added a volumetric equivalent of about 10% of the bonding solution containing a surfactant solution. The surfactant solution comprises a 0.06 wt % solution of a non-ionic surfactant, Triton X-100. An additional volume of cellosolve acetate is added to the bonding solution at a volumetric equivalent of about 10% of the bonding solution. The bonding solution was sprayed onto a piece of mild carbon 1010 steel that had been pre-treated with one coat of a basecoat composition as set forth in Example 1.

The topcoat bonding solution was found to have very good sprayability. After drying at about 175° F. for about 10 minutes and then curing at 650° F. for about 30 minutes, the coated steel panel was subjected to salt spray testing. After more than 200 hours of 5% salt spray exposure, the coated panel showed no signs of red rust.

This protective coating was also prepared and applied, as set forth above, to a metal test substrate that was bent 90° around a mandrel. The cured coating remained intact and did not flake or crack from the surface of the substrate on which it had been applied.

EXAMPLE 4

A pigmented protective topcoat was prepared from the respective bonding solutions set forth in Examples 1, 2, or 3, having the formulation:

| | |
|---|---|
| 180 g | topcoat solution |
| 12.9 g | deionized water |
| 18 ml | surfactant solution |
| 5.6 g | magnesium ferrite |
| 18 ml | cellosolve acetate |

The surfactant solution is an aqueous solution prepared having 0.06 wt % Triton X-100 non-ionic surfactant. This topcoat formulation was applied to 1010 steel pre-treated with one coat of a basecoat composition as described in Example 1 and subjected to the variety of performance tests set forth in Table I. The pigmented topcoat passed all tests. By way of comparison, a commercially available pigmented chromate-containing phosphate topcoat (SermaSeal 570A from Sermatech) was subjected to the same performance tests after application to the basecoat set forth in Example 1. The pigmented chromate-containing topcoat passed all tests listed in Table I. Thus, the chromate-free, pigmented topcoat of the present invention performed as well as chromate-containing pigmented topcoats.

EXAMPLE 5

A clear topcoat composition was prepared, having the formulation:

| | |
|---|---|
| 192.2 g | deionized water |
| 90.7 g | 85% phosphoric acid |
| 16 g | ferric nitrate nonahydrate |
| 16 g | aluminum nitrate nonahydrate |
| 1.6 g | boron oxide |
| 40.1 g | magnesium carbonate |

To this formulation was added a volumetric equivalent of about 10% of the bonding solution containing a surfactant solution. The surfactant solution comprises a 0.06 wt % solution of a non-ionic surfactant, Triton X-100. An additional volume of cellosolve acetate is added to the bonding solution at a volumetric equivalent of about 10% of the bonding solution. The bonding solution was sprayed onto a piece of mild carbon 1010 steel (to a thickness of about 0.1 mil) that had been pre-treated with one coat of a basecoat composition as set forth in Example 1. The topcoat solution had a pH of 2.0. The topcoat formulation was then dried and cured.

The surface finish was measured. The surface finish, $R_a$, was measured at 27 microinches at 0.030 inches cut-off.

For purposes of comparison, a chromate-containing topcoat composition was prepared according to a basecoat formulation set forth in U.S. Pat. No. 3,395,027 to Klotz (at Example 3 therein), though exclusive of aluminum powder. This prepared reference formulation contained 16 g chromium oxide, 24 ml 85% phosphoric acid, 40 ml 70.5% nitric acid, 30 g magnesium oxide, and deionized water in sufficient quantity to bring the solution to 200 ml total.

The chromate-containing bonding solution was identically applied to a 1010 steel panel pre-treated with a basecoat as described for the chromate-free coating. After curing, a surface finish value of $R_a$=152 microinches at 0.030 inches cut-off was measured.

Thus, the chromate-free phosphate/nitrate topcoat of the present invention enabled a coating surface to be formed having a smoothness an order of magnitude better than a chromate-containing formulation modified from the prior art.

EXAMPLE 6

A bonding solution for application as a clear protective topcoat was prepared, having the formulation:

| | |
|---|---|
| 59.6 g | deionized water |
| 28.9 g | 85% phosphoric acid |
| 3.0 g | ferric nitrate nonahydrate |
| 6.0 g | aluminum hydroxide |
| 6.0 g | magnesium carbonate |

This formulation was dried and cured in an aluminum pan. The composition resulted in a desirably smooth, hard, glossy coating.

EXAMPLE 7

A bonding solution for application as a clear protective topcoat was prepared, having the formulation:

| | |
|---|---|
| 59.6 g | deionized water |
| 28.9 g | 85% phosphoric acid |
| 14.6 g | cerium(III) nitrate hexahydrate |
| 1.1 g | aluminum hydroxide |
| 11.4 g | magnesium carbonate |

This formulation was dried and cured in an aluminum pan. The composition resulted in a desirably smooth, hard, glossy coating.

EXAMPLE 8

A bonding solution for application as a clear protective topcoat was prepared, having the formulation:

| | |
|---|---|
| 32.9 g | deionized water |
| 15.2 g | 85% phosphoric acid |
| 1.8 g | 70.5% nitric acid |
| 0.6 g | cobalt (metal powder) |
| 5.5 g | magnesium carbonate |

The pH of the solution was 1.7. This formulation was dried and cured in an aluminum pan. The composition resulted in a desirably smooth, hard, glossy coating.

EXAMPLE 9

A bonding solution for application as a clear protective topcoat was prepared, having the formulation:

| | |
|---|---|
| 32.9 g | deionized water |
| 15.2 g | 85% phosphoric acid |
| 1.8 g | 70.5% nitric acid |
| 0.65 g | copper (metal powder) |
| 4.5 g | magnesium carbonate |

The pH of the solution was 1.6. This formulation was dried and cured in an aluminum pan. The composition resulted in a desirably smooth, hard, glossy coating.

EXAMPLE 10

A bonding solution for application as a clear protective topcoat was prepared, having the formulation:

| | |
|---|---|
| 32.9 g | deionized water |
| 15.2 g | 85% phosphoric acid |
| 1.84 g | 70.5% nitric acid |
| 7.4 g | magnesium carbonate |

The pH of the solution was 2.5. This formulation was dried and cured in an aluminum pan. The composition resulted in a desirably smooth, hard, glossy coating.

EXAMPLE 11

A basecoat composition as described in Example 1 was sprayed onto a 403 stainless steel compressor blade of the type commonly used in industrial ground-based turbines. After drying, curing, and grit burnishing of the basecoat, a clear topcoat as described in Example 1 was sprayed onto the basecoated-compressor blade. After drying at about 175 degrees F. for about 10 minutes and then curing at 650 degrees F. for about 30 minutes, the coated compressor blade was subjected to salt spray testing. After more than 200 hours of 5% salt spray exposure, the coated compressor blade showed no signs of red rust.

It will be appreciated that an unpigmented composition of the present invention provides, upon curing, clear topcoat having a glossy appearance. The cured topcoat composition also passes a battery of ASTM performance standards. The composition is also chromate- and molybdate-free. The composition can also provide superior surface finish values necessary for specialized applications.

It is further understood that the present invention is not limited to the particular embodiments shown and described herein, but that various changes and modifications may be made without departing from the scope and spirit of the invention.

What is claimed is:

1. A heat curable protective coating composition for providing barrier protection to a solid substrate, the composition comprising:

(a) an aqueous solution containing phosphate ions, borate ions, and nitrate ions;

(b) at least one species of metal ion having a valency greater than +1;

(c) the composition having a pH in the range from about 0.5 to about 3.5; and (d) wherein the composition is substantially free of chromate ions and molybdate ions.

2. A coating composition as in claim 1, wherein the metal ions of the composition are selected from the group consisting of aluminum ions, manganese ions, magnesium ions, cerium ions, cobalt ions, chromium(III) ions, nickel ions, iron ions, copper ions, and zinc ions.

3. A coating composition as in claim 1, wherein boron oxide is the source of borate ions.

4. A coating composition as in claim 1, wherein the phosphate ions and the nitrate ions are present in the composition in a mole ratio of phosphate ions to nitrate ions in the range from about 1.5:1 to about 15:1 and the phosphate ions and the metal ions are present in the composition in a mole ratio of phosphate ions to metal ions greater than or equal to about 1:1.

5. A coating composition as in claim 1, wherein the borate ions and the phosphate ions are present in the composition in a mole ratio of borate ions to phosphate ions less than or equal to about 0.5:1.

6. A heat curable protective coating composition for providing barrier protection to a solid substrate, the composition comprising:

(a) an aqueous solution containing phosphate ions, borate ions, and nitrate ions;

(b) at least one species of metal ion having a valency greater than +1;

(c) a pigment;

(d) the composition having a pH in the range from about 0.5 to about 3.5;

(e) wherein the composition is substantially free of chromate ions and molybdate ions.

7. A coating composition as in claim 6, wherein the metal ions of the composition are selected from the group consisting of aluminum ions, manganese ions, magnesium ions, cerium ions, cobalt ions, chromium(III) ions, nickel ions, iron ions, copper ions, and zinc ions.

8. A coating composition as in claim 6, wherein boron oxide is the source of borate ions.

9. A coating composition as in claim 6, wherein the composition provides barrier protection to the solid substrate as a topcoat.

10. A coating composition as in claim 6, wherein the phosphate ions and the nitrate ions are present in the composition in a molar ratio of phosphate ions to nitrate ions in the range from about 1.5:1 to about 15:1 and the phosphate ions and the metal ions are present in the composition in a mole ratio of phosphate ions to metal ions greater than or equal to about 1:1.

11. A coating composition as in claim 6, wherein the borate ion and the phosphate ion are present in the composition in a mole ratio of borate ion to phosphate ion less than or equal to about 0.5:1.

12. A method for coating a solid substrate which comprises applying the composition of claims 1, 2, 4, 8, 9, 10, 11, 8, 9, 10, or 11 to the surface of the substrate and subjecting the substrate to heating to cure the coating.

13. A method for coating a metal substrate pre-treated with a corrosion resistant basecoat which comprises applying the composition of claims 1, 2, 4, 8, 9, 10, 11, 8, 9, 10, or 11 to the surface of the basecoat and subjecting the substrate to heating to cure the coating.

14. An article of manufacture comprising (a) a solid substrate having deposited thereon a layer formed by coating said substrate with and then drying and heat curing a composition comprising:

(i) an aqueous solution containing phosphate ions, borate ions, and nitrate ions;

(ii) at least one species of metal ion having a valency greater than +1;

(iii) the composition having a pH in the range from about 0.5 to about 3.5;

(iv) wherein the composition is substantially free of chromate ions and molybdate ions.

15. An article of manufacture as in claim 14, wherein the composition further contains a pigment.

16. An article of manufacture as in claim 14, wherein the metal ions of the composition are selected from the group consisting of aluminum ions, manganese ions, magnesium ions, cerium ions, cobalt ions, chromium(III) ions, nickel ions, iron ions, copper ions, and zinc ions.

17. An article of manufacture as in claim 14, wherein the layer formed by coating the substrate has a surface profile less than 30 microinches at a 0.030 inch cut-off.

18. An article of manufacture as in claim 14, wherein the layer formed by coating the substrate is substantially clear and has a glossy appearance.

19. An article of manufacture as in claim 14, wherein the layer formed by coating the substrate provides barrier protection to the solid substrate as a topcoat.

20. A heat curable protective coating composition for providing barrier protection to a solid substrate, the composition comprising:

(a) an aqueous solution containing phosphate ions, borate ions, and nitrate ions;

(b) at least one species of metal ion having a valency greater than +1;

(c) the composition having a pH in the range from about 0.5 to about 3.5; and (d) wherein the composition is substantially free of chromate ions.

21. A coating composition as in claim 20, wherein the composition further contains molybdate ions.

* * * * *